United States Patent [19]

Comolli et al.

[11] Patent Number: 4,839,030

[45] Date of Patent: Jun. 13, 1989

[54] COAL LIQUEFACTION PROCESS UTILIZING COAL/$CO_2$ SLURRY FEEDSTREAM

[75] Inventors: Alfred G. Comolli, Yardley, Pa.; Joseph B. McLean, S. Somerville, N.J.

[73] Assignee: HRI, Inc., Lawrenceville, N.J.

[21] Appl. No.: 199,493

[22] Filed: May 27, 1988

[51] Int. Cl.[4] ..... G10G 1/06

[52] U.S. Cl. ..... 208/403; 208/435; 208/413; 208/952

[58] Field of Search ..... 208/403, 413, 419, 435, 208/428, 952

[56] References Cited

U.S. PATENT DOCUMENTS 4,330,393 5/1982 Rosenthal et al. ..... 208/430
4,379,744 4/1983 Rosenthal et al. ..... 208/430 X

OTHER PUBLICATIONS

"Distribution System for Micronized Coal Using Liquid Carbon Dioxide", C. J. Santhanan et al., Technical Paper No. 55, presented at Pittsburg Energy Conference, 1986.

*Primary Examiner*—Glenn Caldarola
*Attorney, Agent, or Firm*—Fred A. Wilson

[57] ABSTRACT

A coal hydrogenation and liquefaction process in which particulate coal feed is pressurized to an intermediate pressure of at least 500 psig and slurried with $CO_2$ liquid to provide a flowable coal/$CO_2$ slurry feedstream, which is further pressurized to at least 1000 psig and fed into a catalytic reactor. The coal particle size is 50–375 mesh (U.S. Sieve Series) and provides 50–80 W % coal in the coal/$CO_2$ slurry feedstream. Catalytic reaction conditions are maintained at 650°–850° F. temperature, 1000–4000 psig hydrogen partial pressure and coal feed rate of 10–100 lb coal/hr $ft^3$ reactor volume to produce hydrocarbon gas and liquid products. The hydrogen and $CO_2$ are recovered from the reactor effluent gaseous fraction, hydrogen is recycled to the catalytic reactor, and $CO_2$ is liquefied and recycled to the coal slurrying step. If desired, two catalytic reaction stages close coupled together in series relation can be used. The process advantageously minimizes the recycle and processing of excess hydrocarbon liquid previously needed for slurrying the coal feed to the reactor(s).

15 Claims, 3 Drawing Sheets

PRESSURE-ENTHALPY CHART FOR CARBON DIOXIDE

COAL LIQUEFACTION PROCESS UTILIZING COAL/$CO_2$ SLURRY FEEDSTREAM

BACKGROUND OF INVENTION

This invention pertains to an improved coal liquefaction process in which particulate coal is slurried with liquid carbon dioxide to provide a flowable feedstream. It pertains particularly to a coal hydrogenation and liquefaction process in which pressurized particulate coal feed is slurried with liquid carbon dioxide, before being further pressurized and fed into a catalytic reactor for producing hydrocarbon gas and liquid products.

For known coal liquefaction processes, the coal feed in particulate form is conventionally slurried with a hydrocarbon liquid such as recycled solvent oil and then pressurized sufficiently to feed the coal/oil slurry into a catalytic reactor operated at high temperature and pressure conditions. Examples of such coal liquefaction processes are disclosed by U.S. Pat. No. 3,519,555 to Keith et al, U.S. Pat. No. 3,617,465 to Wolk et al, U.S. Pat. No. 3,700,584 to Johanson et al, and U.S. Pat. No. 4,437,973 to Huibers et al. Although such coal-/oil slurrying systems have been found useful in coal liquefaction processes, they have the disadvantage of requiring the processing of undesirably large quantities of recycled oil needed only for the coal slurrying and feeding purposes. Also, a method for feeding substantially dry coal particles to a high reactor pressure by utilizing special screw feeder devices connected in series is disclosed by U.S. Pat. No. 3,775,071 to Hoffert et al. But such dry coal feeding devices have been found to be complicated and unreliable, and have not been used commercially in coal liquefaction processes.

It is also known to prepare slurries of particulate coal and water or liquid $CO_2$ to produce relatively high coal concentrations for transfering coal through pipelines and for feeding such slurries to coal burners and combustion systems, such as used in fired boilers for generating steam. However, such combustion processes are utilized at only relatively low pressures such as 15–100 psig. These disadvantages of the prior coal/oil slurry feeding to liquefaction processes have now been unexpectedly overcome by the present invention, which provides an improved coal liquefaction process having only minimal need for recycling a coal-derived slurrying oil to the coal slurrying step in the process.

SUMMARY OF INVENTION

The present invention provides an improved process for the hydrogenation and liquefaction of coal to produce hydrocarbon liquid and gas products, and provides for slurrying substantially dry particulate coal with liquid carbon dioxide at a temperature below its critical temperature and at an intermediate pressure, then pumping the coal/$CO_2$ liquid slurry feedstream at its low temperature into a catalytic ebullated bed reaction zone. Any supplemental heat needed for the exothermic hydrogenation reactions in the reaction zone is provided via a heated hydrogen feed stream, and/or by heating the reactor liquid recycled to the ebullated bed reactor. Specifically, the process utilizes a feedstream of particulate coal slurried with sufficient liquid $CO_2$ to provide a flowable mixture. The coal, having particle size of 50–325 mesh (U.S. Sieve Series) or smaller micron size particles, is first pressurized to an intermediate pressure of at least about 500 psig and preferably to 550–1000 psig, and is slurried with sufficient liquid $CO_2$ to produce the flowable coal/$CO_2$ liquid slurry feedstream. The liquid $CO_2$, which is maintained at a critical temperature below about 85° F. and preferably at 40°–80° F., effectively wets the coal particles to provide a flowable coal/$Co_2$ slurry containing coal concentrations of at least about 50 W % coal and preferably 60–90 W % coal. If necessary to prevent premature evaporation and to maintain flowability of the feedstream, the coal/$CO_2$ slurry can be cooled to some extent either by cooling the slurry mixing tank using a refrigerant, or by controlled evaporation of a portion of the liquid $CO_2$ from the slurry during handling.

The resulting coal/$CO_2$ slurry at temperature below about 85° F. is further pressurized to at least about 1000 psig and fed into a mixing chamber, such as the lower plenum of a reactor containing an ebullated catalyst bed. Heated hydrogen gas is fed separately into the reactor plenum mixing chamber, where the coal and $CO_2$ are mixed with the heated hydrogen gas and recycled reactor liquid. The $CO_2$ is at least partially evaporated from the slurry, while the coal and recycled reactor liquid are passed upwardly through a flow distributor into the catalyst bed, which is maintained at temperature of 650°–850° F. Because of the need for maintaining temperatures for the coal/$CO_2$ slurry feed stream below about 85° F. to avoid premature undesired evaporation of the $CO_2$ liquid upstream of the reactor zone, the desired temperature and heat of reaction in the reactor are maintained either by heating the hydrogen gas feed stream to a temperature somewhat above the catalyst bed temperature, or by heating the recycled reactor liquid used for maintaining catalyst bed ebullation, or both.

Also in the lower plenum of the reactor, the liquid $CO_2$ contained in the coal/$CO_2$ slurry feedstream is rapidly heated and evaporated, which contributes to further fracturing of the coal particles without fracturing the mineral matter, and facilitates separation of the mineral matter contained in the coal. Also in the catalytic reaction zone, the $CO_2$ participates in the reaction via hydrogen reduction to form methane, hydrocarbons, alcohols, formates, lactones and other oxygenates and compounds. The $CO_2$, as a consequance of its reactivity and mole fraction, will have a minimal effect on hydrogen partial pressure in the reactor. Sufficient hydrocarbon solvent liquid is usually internally-generated from the coal feed to provide adequate liquid recycle and back-mixing of the coal feed and catalyst in the ebullated bed reaction zone. The coal/$CO_2$ slurry is fed into the catalytic reaction zone, which is maintained at selected moderate temperature and pressure conditions and in the presence of a particulate hydrogenation catalyst which promotes controlled rate hydrogenation and liquefaction of the coal, while simultaneously hydrogenating the recycle solvent oils at conditions which favor hydrogenation reactions. The reaction zone contains an ebullated bed of a particulate hydrogenation catalyst to hydrogenate the aromatic rings in the coal, recycle solvent and dissolved coal molecules, and produces the desired low-boiling hydrocarbon liquid and gaseous product materials. Useful reaction conditions are 650°–850° F. temperature and 1000–4000 psig hydrogen partial pressure, with coal feed rate of 10–100 lb coal/$ft^3$ reactor volume.

The catalyst used should contain an active metal oxide or other metal compound selected from the metals group consisting of cobalt, iron, molybdenum, nickel, tin, tungsten and other hydrocarbon hydrogenation catalyst metals known in the art, deposited on a base material selected from the group consisting of alumina, magnesia, silica, titania, and similar materials. Useful catalyst particle sizes can range from about 0.030 to 0.125 inch effective diameter.

The concentration of $CO_2$ gas in the reaction zone will depend not only on the percentage of liquid $CO_2$ provided in the coal/$CO_2$ slurry feedstream, but also depend on the oxygen content of the coal feed. Coal having relatively large particle size will generally require a greater percentage of liquid $CO_2$ to provide a flowable coal/$CO_2$ slurry. Also, low rank sub-bituminous type coal and lignites usually contain 15–30 W % oxygen and generate more $CO_2$ in the reaction zone than bituminous coals which contain only about 6–10 W % oxygen. The concentration of the $CO_2$ in the reaction zone will usually vary from about 2 mole % for micronized bituminous coals (25–100 micron particle size) up to about 10 mole % for −100 mesh size (U.S. Sieve Series) sub-bituminous coals. Also, the quantity of $CO_2$ generated in the reaction zone from the oxygen contained in the coal feed is very dependent on the process severity, i.e. reaction zone temperature, hydrogen partial pressure and residence time and the organic oxygen bonding structure of the coal.

From the reaction zone, the effluent material containing hydrocarbon gas and liquid fractions is phase separated. The resulting gas fraction is processed to recover and liquefy sufficient $CO_2$ for recycle to the coal slurrying step, and to recover hydrogen for recycle to the reactor. Off-gases from the process include $CO_2$, CO, $CH_4$, $H_2S$, $NH_3$ and other light hydrocarbons. Recovery of $CO_2$ for recycle to the coal slurrying step need not be complete, and may contain other components such as CO and methane as supplemental hydrogen sources. The hydrocarbon liquid fraction is pressure-reduced and distilled to produce hydrocarbon gases and low boiling hydrocarbon distillate liquid products, and the remaining unconverted coal and mineral matter is removed from the process.

Although this invention can be advantageously used for single stage catalytic reaction processes for liquefying coal, it is preferably used in a catalytic two-stage coal liquefaction process. In such catalytic two stage process, the coal/$CO_2$ slurry at 500–950 psig pressure is further pressurized and fed into a first stage ebullated catalyst bed reactor maintained at conditions of 650°–800° F. temperature, 1000–4000 psig hydrogen partial pressure, and at 10–100 lb coal/hr ft$^3$ reactor feed rate or space velocity to produce a high quality hydrocarbon solvent material, while achieving at least about 50 W % conversion of the coal to tetrahydrofuran (THF) soluble materials. At such mild reaction conditions, hydrocracking, condenstation and polymerization reactions along with formation of hydrocarbon gases are all advantageously minimized in the reactor. Preferred first stage reaction conditions are 700°–790° F. temperature, 1500–3500 psig hydrogen partial pressure, and a coal space velocity of 15–75 lbs coal/hr ft$^3$ reactor, with the preferred conditions usually being specific to the type of coal being processed.

From the first stage reaction zone, the total effluent material containing hydrocarbon gases and liquid fractions is preferably passed with additional heated hydrogen directly to a close-coupled second stage catalytic reaction zone, where the material is further hydrogenated and hydrocracked at a temperature preferably at least about 25° F. higher than for the first stage reaction zone. Both stage reaction zones are upflow, back mixed ebullated bed catalytic reactors. For the second stage reactor, operating conditions are preferably maintained at higher severity which promote more complete thermal conversion of the coal to liquids, hydroconversion of primary liquids to distillate products, and product quality improvement via heteroatoms removal, and with similar hydrogen partial pressure and a hydroconversion catalyst, such as cobalt-moly on alumina. Useful second stage reaction conditions are 750°–875° F. temperature, 1000–4000 psig hydrogen partial pressure and coal space velocity of 10–100 lb coal/hr ft$^3$ reactor volume to achieve at least about 90 W % conversion of the remaining reactive coal along with the asphaltene and preasphaltene compounds to lower boiling hydrocarbon materials, and the heteroatoms are further reduced to provide tetrahydrofuran (THF) soluble product materials. Preferred second stage reaction conditions are 800°–860° F. temperature, 1500–3500 psig hydrogen partial pressure, and coal space velocity of 15–75 lb/hr ft$^3$ reactor volume.

From the second or last stage reactor, an effluent stream containing hydrocarbon gas and liquid fractions is withdrawn and phase separated. The resulting gas fraction is treated to recover and liquefy sufficient $CO_2$ for recycle to the coal slurrying step, and to recover hydrogen for recycle to the reactor. The hydrocarbon liquid fraction is pressure-reduced and distilled to produce hydrocarbon gases and distillate liquid products, and any remaining unconverted coal and ash solids is withdrawn from the system.

This invention advantageously provides a process for hydrogenation and liquefaction of coal which does not require recycle of any substantial quantity of hydrocarbon liquid for slurrying the coal feed, and thereby desirably reduces the size of the catalytic reactor(s) and downstream processing equipment required for a particular coal feed rate, and also facilitates the net yield of low-boiling hydrocarbon liquid products. It is also an attribute of this invention that the $CO_2$ contained in the coal slurry feedstream has only a minor effect on the hydrogen partial pressure in the reaction zone(s) and also the $CO_2$ gas has only a minor effect on reactor volume. The process is facilitated by the internally-generated hydrocarbon liquid solvent produced in the first stage back mixed catalytic ebullated bed reactor.

BRIEF DESCRIPTION OF DRAWINGS

The process will be further described with reference to the following drawings, in which.

DESCRIPTION OF INVENTION

Figure 1:
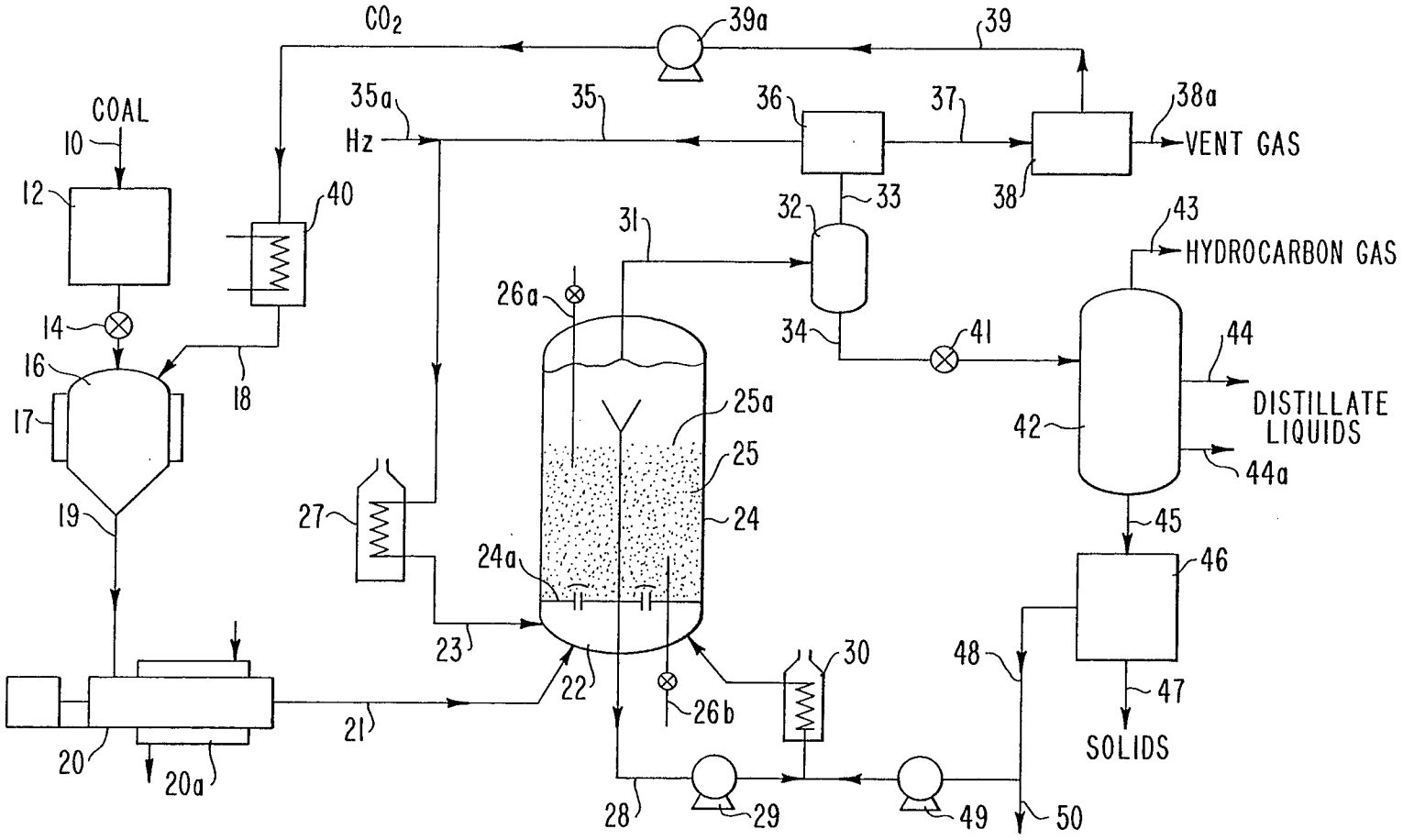
FIG. 1 is a schematic flow diagram of a coal hydrogenation and liquefaction process according to the invention which utilizes a coal/$CO_2$ slurry feedstream into a single catalytic reactor.

By this invention, improved hydrogenation and liquefaction of coal is achieved by slurrying the coal in liquid $CO_2$ at a critical temperature and an intermediate pressure, then further pressurizing and feeding the coal/$CO_2$ slurry feedstream to the catalytic reactor. As shown in FIG. 1, a coal such as bituminous, sub-bituminous, or lignite is provided at 10 and passed to a preparation unit 12, where the coal is ground to a desired particle size range such as 50–375 mesh (U.S. Sieve Series), or finer and may be dried to a desired moisture content of 3–10 W % moisture remaining. The particulate coal is then passed through a suitable feeding device 14, such as a rotary feeder valve or dual lock hoppers, into a pressurized mixing tank 16 which is maintained at 500–1000 psig intermediate pressure. In tank 16, the particulate coal is mixed with sufficient pressurized liquid $CO_2$ provided at 18 to produce a flowable coal/$CO_2$ slurry mixture. If desired, cooling the mixing tank 16 can be provided by a surrounding heat exchange jacket 17 adapted for circulating a refrigerant fluid through the jacket.

Figure 2:
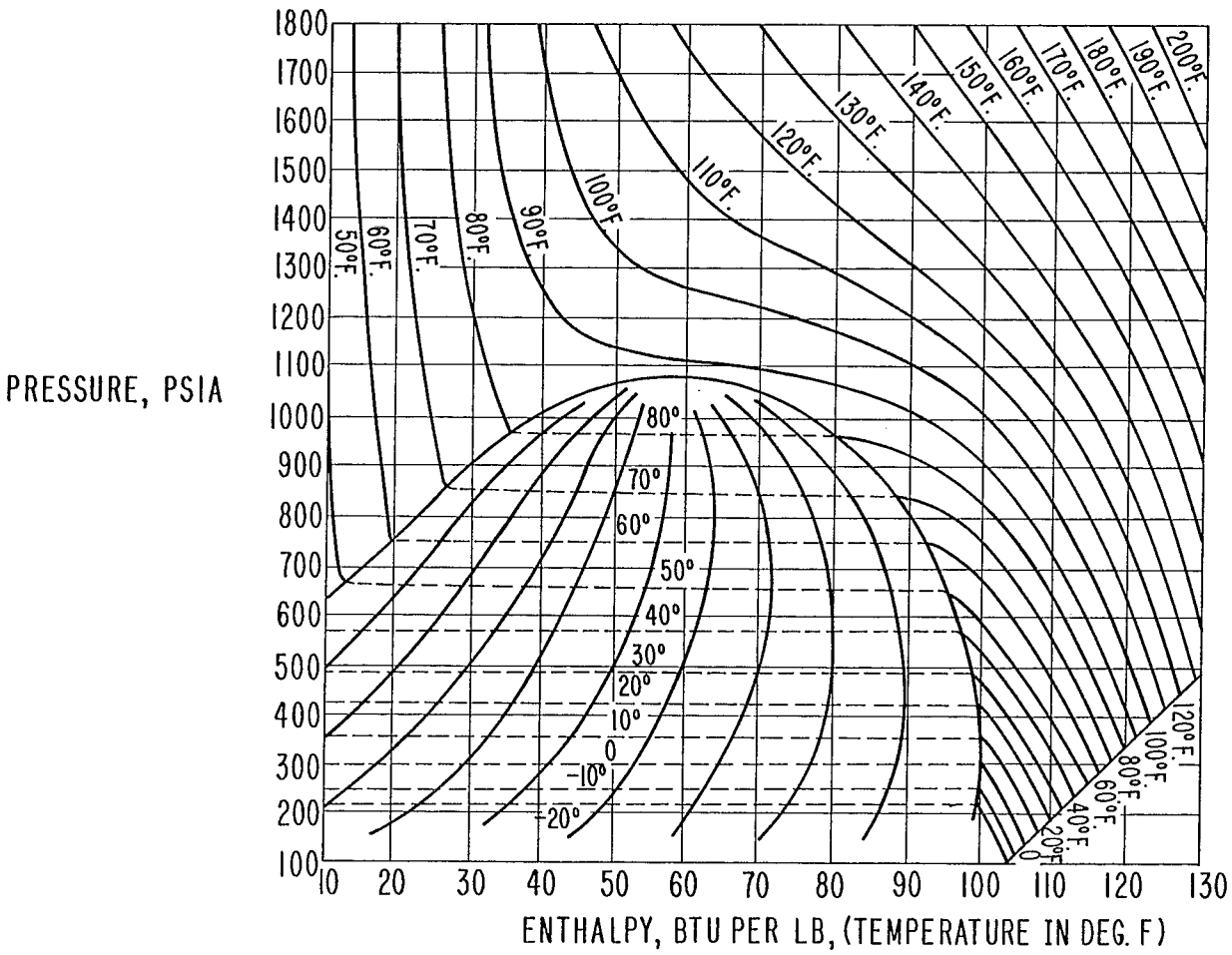
FIG. 2 is a partial pressure-enthalpy chart for carbon dioxide showing the required pressure-temperature relationships in the coal/$CO_2$ slurry mixing tank and catalytic reactor.

The liquid $CO_2$ stream 18 is maintained at below its critical temperature of about 85° F., and preferably at 40°–80° F. and at pressure of 500 –1000 psig, as shown by the FIG. 2 pressureenthalpy chart, so as to cool the ground coal (which has usually been preheated to some extent by the grinding step), to the desired coal/$CO_2$ slurry temperature. At higher pressures, increased slurry temperatures are permitted as shown in the FIG. 2 chart. In mixing tank 16, the $CO_2$ liquid effectively wets the coal particles to provide a flowable coal/$CO_2$ slurry containing at least about 50 W % coal, and preferably 60–85 W % coal concentration in the slurry.

The resulting coal/$CO_2$ slurry 19 at intermediate pressure of 500–1000 psig is further pressurized by pump 20, in which the slurry is cooled during pressurization by a suitable cooling fluid flowing in pump jacket **20*a*, to prevent heating and premature vaporization of the $CO_2$ from the slurry feed stream 21 before it is introduced into the lower plenum 22 of catalytic reactor 24. Heated hydrogen gas at 23 is introduced separately into the reactor plenum 22. In the lower plenum chamber 22, the coal/$CO_2$ slurry stream 21 is heated rapidly, and the $CO_2$ liquid is substantially evaporated while the particulate coal is mixed uniformly with the hydrogen gas 23 and with recycled reactor liquid, and all are passed uniformly upwardly through distribution grid plate 24*a* into the reactor ebullated catalyst bed 25**.

Because the coal/$CO_2$ slurry feedstream 21 is usually not preheated before being introduced into catalytic reactor 24, at least a portion of the additional heat needed therein is provided by hydrogen stream 23 which can be heated at heater 27 to above the catalyst bed temperature. Alternatively, the reactor recycled liquid stream 28 which is withdrawn from above the catalyst bed 25 and recirculated by pump 29 can be heated at heater 30 to a temperature above the catalyst bed temperature before being reintroduced into plenum 22. Such rapid heating in plenum 22 of the coal particles which contains appreciable amounts of absorbed liquid $CO_2$ liquid causes the $CO_2$ to expand rapidly and fracture the coal particles. Such fracturing of the coal into finer particles facilitates its intimate contact with the hydrogen gas and coal derived solvent liquid, and contributes to catalytic hydrogenation and liquefaction of the coal. Also such fracturing of the coal facilitates separation of ash solids from the coal-derived hydrocarbon liquids.

The coal/$CO_2$ slurry and hydrogen streams entering reactor 24 pass uniformly upwardly through flow distributor **24*a* and ebullated catalyst bed 25, at a desired flow rate and at temperature and pressure conditions to expand the bed to upper level 25*a* and to accomplish the desired hydrogenation reactions. The operation of the ebullated bed catalytic reactor including recycle of reactor liquid upwardly through the expanded catalyst bed is generally known and is described by U.S. Pat. No. 4,437,973, which is incorporated herein by reference. The reactor 24 contains bed 25 of a particulate hydrogenation catalyst such as cobalt molybdate, nickel molybdate, or nickel tungsten deposited on a porous alumina or silica support material. In addition, fresh particulate hydrogenation catalyst may be added to reactor 24 at connection 26*a* in the ratio of about 0.1 to 3 pounds of catalyst per ton of coal processed. Used catalyst may be removed from reactor 24 at connection 26*b*** to maintain the desired catalytic activity within the reactor.

Operating conditions in the catalytic reactor 24 are maintained at moderate temperature range of 700°–850° F., 1000–4000 psig partial pressure, and coal feed rate or space velocity of 10–100 lb coal/hr $ft^3$ reactor volume. Preferred reaction conditions are 710°–800° F. temperature, 1500–3500 psig hydrogen partial pressure and 15–75 lb coal/hr $ft^3$ reactor volume, and will be specific to the particular coal being processed, as different coals convert to liquids under thermal conditions at different rates. The optimal reaction conditions will allow maximum utilization of hydrogen shuttling solvent compounds, such as pyrene/hydropyrenes, known to be present in coal-derived recycled oils, since catalytic rehydrogenation of donor species occurs simultaneously with solvent-to-coal hydrogen transfer. Coal-derived oils are also exposed to an efficient catalytic hydrogenation atmosphere immediately upon their formation, thereby reducing the tendency for regressive repolymerization reactions which lead to poor quality hydrocarbon liquid products. The evaporated $CO_2$ gas at a concentration of 2–10 mole % in the liquid and in a reducing atmosphere can also participate in the reaction to form hydrocarbons and oxygenated compounds. The thermal severity has been found to be quite important, as too high a severity leads to a coal conversion rate which is too rapid for the catalytic hydrogenation reactions to keep pace, as well as poorer hydrogenation equilibrium for the solvent compounds. Too low a thermal severity in the reactor, while still providing an efficient atmosphere for solvent hydrogenation, does not provide sufficient coal conversion to provide a substantial process improvement.

In the reactor 24, the objective is to hydrogenate the aromatic rings in molecules of the feed coal, solvent liquid and dissolved coal so as to produce a high quality hydrogen donor solvent liquid in the presence of hydrogen and the hydrogenation catalyst. At the catalytic reaction conditions used, heteroatoms are removed, retrogressive or coke forming reactions are essentially eliminated, and hydrocarbon gas formations are effectively minimized. Because of the reaction conditions used, the catalyst promotes coal hydrogenation and minimizes polymerization and cracking reactions. Also, because of these improved conditions in the reactor, less coke is deposited on the catalyst at the milder reaction conditions used, which minimizes catalyst deactivation and appreciably prolongs the effective life of the catalyst.

From the catalytic reactor 24, the effluent material is withdrawn at 31 and passes to a phase separator 32 operating at near reactor conditions, wherein a vapor fraction 33 is separated from a solids-containing liquid slurry fraction 34. The vapor fraction 33 is treated at hydrogen purification section 36, from which recovered hydrogen stream 35 is withdrawn for reheating at 27 and recycle as stream 23 to the reactor 24. Fresh make-up hydrogen gas is added as needed at 35*a*. From hydrogen purification section 36, the remaining gas 37 containing mainly $CO_2$ is purified at section 38. The resulting $CO_2$ gas 39 is recycled by compressor 39*a* to liquefier 40, from which the liquid $CO_2$ at 18 is introduced to the coal slurrying step 16. A vent gas containing undesired nitrogen and sulfur compounds is removed as stream 38*a*.

The slurry liquid fraction 34 is pressure-reduced at 41 to near atmospheric pressure, such as about 200 psig, and passed to a distillation system generally shown at 42. The resulting liquid fractions are recovered by vapor/liquid flash in the distillation system 42, including atmospheric and vacuum distillation steps to produce hydrocarbon gas stream 43, light distillate liquid product stream 44 and heavier higher-boiling distillate liquid stream 44*a*. A bottoms stream 45 is passed to a liquid-solids separation step 46, from which unconverted coal and ash solids are removed at 47. The liquid-solids separation step 46 can use known solids removal means, such as hydroclones, centrifuges, filters or solvent deashing techniques, with use of liquid hydroclones usually being preferred. If desired, a hydrocarbon liquid stream 48 containing reduced concentration of solids can be recycled by pump 49 to the reactor plenum 22 to enhance the yield of low boiling hydrocarbon liquid products. Also, if desired, a reduced solids concentration product liquid stream can be withdrawn at 50.

Figure 3:
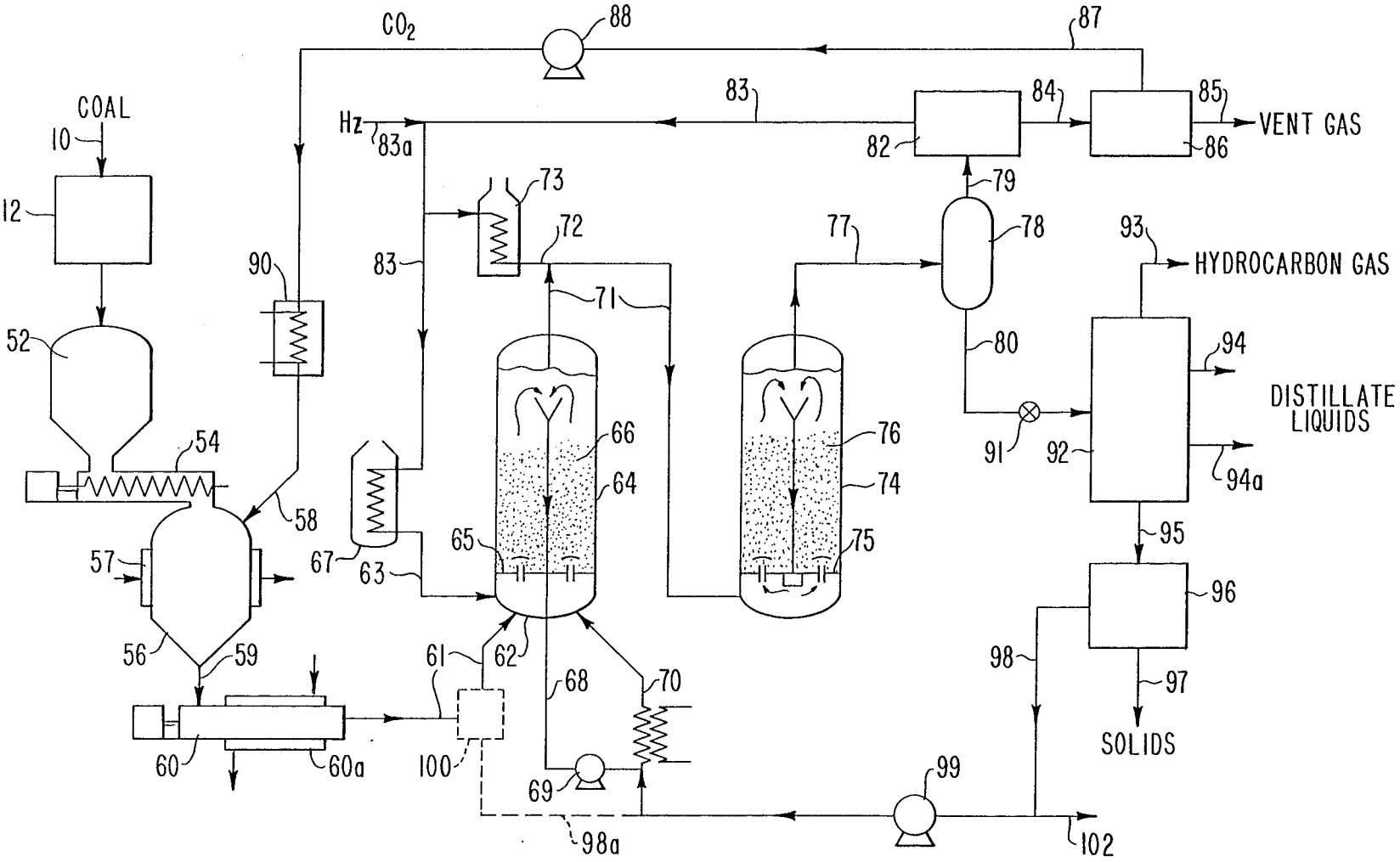
FIG. 3 is a schematic diagram of a coal hydrogenation and liquefaction process utilizing an alternative flow arrangement for feeding the coal/$CO_2$ slurry feed stream into the first stage reactor of a two-stage catalytic hydrogenation process for producing low-boiling hydrocarbon gas and liquid products.

An alternative embodiment of the invention utilizing catalytic two stage liquefaction will be described with reference to FIG. 3. The particulate coal 10 provided to feed tank 52 is passed through a screw type feeding and pressurizing device 54 into a mixing tank 56, which is maintained at 500–1000 psig pressure. In the tank 56, the particulate coal is mixed with sufficient pressurized liquid $CO_2$ provided at 58 to produce a flowable coal/-$CO_2$ slurry mixture. If desired, cooling the mixing tank 56 can be provided by a surrounding heat exchange jacket 57 adapted for circulating a refrigerant fluid. The liquid $CO_2$ stream 58 is maintained at a critical temperature below about 85° F., and preferably at 40°–80° F. and at intermediate pressure of 500–1000 psig, so as to cool the ground coal which has usually been preheated to some extent by grinding at 12 and the initial pressurizing step 54, to the desired coal slurry temperature. In mixing tank 56, the $CO_2$ liquid effectively wets the coal particles to provide a flowable coal/$CO_2$ slurry containing at least about 50 W % coal, and preferably 60–85 W % coal concentration in the slurry.

The resulting coal/$CO_2$ slurry 59 at intermediate pressure of 500–1000 psig is further pressurized at pump 60, in which the slurry is cooled during the pressurization by a cooling fluid flowing in pump jacket 60*a*. Such cooling prevents heating and premature vaporization of the $CO_2$ from the slurry feedstream 61 before it is introduced into the lower plenum 62 of catalytic reactor 64. Heated hydrogen gas at 63 is introduced separately into the reactor plenum 62. In the lower plenum chamber 62, the coal/$CO_2$ slurry is heated rapidly and the $CO_2$ evaporated while the particulate coal is mixed uniformly with the hydrogen gas 63 and with recycled reactor liquid, and all are passed uniformly upwardly through distribution grid plate 65 into the reactor ebullated catalyst bed 66.

Because the coal/$CO_2$ slurry feedstream 61 is usually not preheated before being introduced into catalytic reactor 64, the additional heat needed therein is provided by hydrogen stream 63 which can be heated at heater 67 to above the reaction bed temperature. Alternatively, the reactor recycled liquid stream 68 can be withdrawn and recirculated by pump 69 through heating step 70 to a temperature above the catalyst bed temperature before being reintroduced into plenum 62. Such rapid heating of the coal particles which contain appreciable amounts of absorbed liquid $CO_2$ causes the $CO_2$ to expand rapidly and fracture the coal particles. Such fracturing of the coal into finer particles facilitates its intimate contact with the hydrogen gas and coal solvent liquid, and contributes to effective catalytic hydrogenation and liquefaction of the coal.

The coal/$CO_2$ slurry and hydrogen streams entering reactor 64 pass uniformly upwardly through flow distributor 65 and ebullated catalyst bed 66 at a flow rate and at temperature and pressure conditions to accomplish the desired hydrogenation reactions. The first state reactor 64 contains ebullated bed 66 of particulate hydrogenation catalyst, such as cobalt molybdate, nickel molybdate, or nickel tungsten deposited on a porous alumina or silica support material.

Operating conditions in the first stage reactor are maintained at moderate temperature range of 650°–800° F., 1000–4000 psig hydrogen partial pressure, and coal feed rate or space velocity of 10–100 lb coal/hr $ft^3$ reactor volume. The preferred reaction conditions of 700°–790° F. temperature, 1500–3500 psig hydrogen partial pressure, and 15–75 lb coal/hr $ft^3$ reactor volume, will be specific to the particular coal being processed, as different coals convert to liquids under thermal conditions at different rates. The optimal first stage reaction conditions will allow maximum utilization of hydrogen shuttling solvent compounds, such as pyrene/hydropyrenes, known to be present in coal-derived recycled oils, since catlytic rehydrogenation of donor species occurs simultaneously with solvent-to-coal hydogen transfer. Coal-derived oils are also exposed to an efficient catalytic hydrogenation atmosphere immediately upon their formation, reducing the tendency for regressive repolymerization reactions which lead to poor quality hydrocarbon liquid products. The $CO_2$ gas also actively participates in the hydrogenation reactions and has a concentration of 2–10 mol % in the liquid. First stage reactor thermal severity has been found to be quite important, as too high a severity leads to a coal conversion rate which is too rapid for the catalytic hydrogenation reactions to keep pace, as well as poorer hydrogenation equilibrium for the solvent compounds. Too low a thermal severity in the first stage, while still providing an efficient atmosphere for solvent hydrogenation, does not provide sufficient coal conversion to provide a substantial process improvement.

In the first stage reactor, the objective is to hydrogenate the aromatic rings in molecules of the feed coal, recycle solvent and dissolved coal so as to produce a high quality hydrogen donor solvent liquid in the presence of hydrogen and the hydrogenation catalyst. At the moderate catalytic reaction conditions used, heteroatoms are removed, retrogressive or coke forming reactions are essentially eliminated, and hydrocarbon gas formations are effectively minimized. Because of the reaction conditions used, the catalyst promotes coal hydrogenation and minimizes polymerization and cracking reactions. Also, because of these improved conditions in the first stage reactor, less coke is deposited on the catalyst at the milder reaction conditions used, and the deposited coke also has a desirably high hydrogen/carbon ratio, which minimizes catalyst deactivation and appreciably prolongs the effective life of the catalyst.

From the first stage catalytic reactor 64, the total effluent material at 71 is mixed with additional hydrogen 72 preheated at 73, and flows directly to the lower end of close-coupled second stage catalytic reactor 74. This reactor 74 operates similarly to reactor 64 and contains flow distributor grid 75 and ebullated catalyst bed 76, and is maintained at a temperature at least about 25° F. higher than for the first stage reactor, and usually in the temperature range of 750°-875° F., but a temperatures lower than conventionally used for single-stage catalytic coal liquefaction process. The higher temperature used in reactor 74 may be accomplished by utilization of the preheated hydrogen stream 72 as well as the second stage reactor heat of reaction. The second stage reactor pressure is slightly lower than the first stage reactor to permit forward flow of the coal slurry material the catalytic without any need for pumping. A particulate catalyst similar to that used in the first stage reactor is utilized in bed 76 for the second stage reactor.

In the second stage reactor 74, the reaction conditions are selected to provide a more complete catalytic conversion of the unconverted coal to liquids, utilizing the high quality solvent liquid produced in the first stage reactor. The remaining reactive coal as well as preasphaltenes and asphaltenes are converted to distillate liquid products along with additional heteroatoms removal. Substantial secondary conversion of coal derived liquids to distillate products, and product upgrading by heteroatoms removal, is also accomplished in the second stage reactor. The reaction conditions are selected to minimize gas formation or dehydrogenation of the first stage liquid effluent materials. Useful reactor conditions are 750°-875° F. temperature, 1000-4000 psig hydrogen partial pressure, and coal space velocity of 10-100 lb coal/hr $ft^3$ reactor volume. Preferred reaction conditions will depend on the particular type coal being processed, and are usually 800°-860° F. temperature 1500-3000 psig hydrogen partial pressure and 15-75 lb coal/hr $ft^3$ reactor space velocity.

From the second stage reactor 74, the effluent material at 77 is passed to a phase separator 78 operating at near reactor conditions, wherein a vapor fraction 79 is separated from a solids-containing liquid slurry fraction at 80. The vapor fraction 79 is treated at hydrogen purification section 82, from which hydrogen stream 83 is withdrawn for reheating at heater 67 and recycled as stream 63 to the reactor 64. Fresh make-up hydrogen gas is added as needed at **83*a*. The remaining gas 84 containing principally $CO_2$ is purified at unit 86 and the resulting $CO_2$ stream 87 is recycled by compressor 88 to liquefier unit 90, from which the liquid $CO_2$ stream 58 is introduced to the coal slurrying step 56. A vent gas containing undesired nitrogen and sulfur compounds is removed from purification step 82 as stream 85**.

The solids-containing liquid fraction 80 is pressure-reduced at 91 to near atmospheric pressure, such as about 200 psig, and passed to a distillation system generally shown at 92. The resulting liquid fractions are recovered by vapor/liquid flash in the distillation system 92, including atmospheric and vacumm distillation steps to produce hydrocarbon gas stream 93, light distillate liquid product stream 94 and heavier higher-boiling distillate liquid stream **94*a*. A bottoms stream 95 is passed to a liquid-solids separation step 96, from which unconverted coal and ash solids are removed at 97. The liquid-solids separation step 96 can use known solids removal means such as hydroclones, centrifuges, filters or solvent deashing techniques, with the use of liquid hydroclones usually being preferred. If desired, a liquid stream 98 having reduced concentration of solids can be recycled by pump 99 to heating step 70 and reactor plenum 62 to enhance the yield of low boiling hydrocarbon liquid products. Also, if desired, a portion 98*a* of liquid stream 98 can be introduced into a mixer device 100 to facilitate transfer of the coal/$CO_2$ slurry into the reactor plenum 62. A reduced solids concentration product liquid stream can be withdrawn at 102**.

This invention will be further described and better understood by reference to the following examples of comparative operations, which Examples should not be construed as limiting the scope of the invention.

EXAMPLE 1

Bituminous Illinois #6 coal is ground to 50-325 mesh (U.S. Sieve Series) particle size, then pressurized to 500 psig and admixed with liquid $CO_2$ maintained at 75°-85° F. temperature to provide a flowable slurry having a concentration of 50%-80% coal by weight. The coal/-$Co_2$ slurry is then further pressurized by centrifugal and/or piston pumps to 2500 psig and introduced with hydrogen into the lower plenum of ebullated catalytic reactor maintained at 750°-850° F. temperature, 1000-2000 psig hydrogen partial pressure. The $CO_2$ is evaporated and the coal and hydrocarbon liquid is passed upwardly into the ebullated bed of cobaltmoly catalyst and held for an average coal residence time of 30 -90 minutes. The resulting effluent material is passed to a phase separator to remove gases from light hydrocarbon liquid fractions. The gases are purified and the recovered $CO_2$ liquefied and recycled back to the coal slurrying step, and hydrogen is heated and recycled in the reactor. Bottoms fraction from the separator is pressure-reduced and further separated and distilled to provide useful $C_4$-975° F. hydrocarbon liquid products.

EXAMPLE 2

Dried Illinois #6 coal is micronized to about 30 to 50 microns particle size, then pressurized to 500 psig and admixed with liquid $CO_2$ maintained at 75°-85° F. to provide a concentration of 60%-90% coal by weight. The coal/$CO_2$ slurry is then further pressurized by centrifugal and piston pumps to 2500 psig and delivered with hydrogen to a lower plenum of a first stage ebullated catalytic reactor maintained at 700°-800° F. temperature, 1000-2000 psig hydrogen partial pressure. The $CO_2$ portion is evaporated and the coal and reactor liquid is passed upwardly into an ebullated bed of cobalt-moly catalyst and held for an average coal residence time of 30-90 minutes. The entire effluent material is passed with hydrogen to a second stage catalytic reactor maintained at 800°-850° F. for further hydrogenation and hydro cracking of the coal-derived liquids.

Effluent material from the second stage reactor is passed to a phase separator to remove gases and light hydrocarbon liquid fractions. The gases are purified and the recovered $CO_2$ is liquefied and recycled back to the coal slurrying step, while hydrogen is reheated and recycled to the first stage reactor. Bottoms material from the phase separator is pressure-reduced and further separated and distilled to provide useful $C_4$-975° F. hydrocarbon liquid products.

Although this invention has been described broadly and in terms of certain preferred embodiments thereof, it will be understood that modifications and variation to the process can be made and that some steps can be utilized without others all within the spirit and scope of the invention, which is defined by the following claims.

We claim:

1. A process for hydrogenation and liquefaction of coal utilizing a coal/$CO_2$ slurry feedstream for producing hydrocarbon liquid and gas products, comprising:

(a) pressurizing particulate coal to an intermediate pressure of at least about 500 psig and mixing it with liquid carbon dioxide to provide a flowable coal/carbon dioxide slurry feedstream containing at least about 50 W % coal;

(b) further pressurizing the coal/$CO_2$ slurry and feeding it and hydrogen separately into a reation zone containing an ebullated catalyst bed maintained at 650°-850° F. temperature, 1000-4000 psig hydrogen partial pressure and a coal feed rate of 10-100 lb coal/hr $ft^3$ reactor volume, and producing an effluent material containing hydrocarbon gas and liquid fractions;

(c) separating said gas and liquid fractions, and recovering $CO_2$ and hydrogen from the gas fraction for recycle in the process; and (d) removing unconverted coal and ash from the hydrocarbon liquid fraction, and distilling the remaining hydrocarbon liquid to produce gas and low boiling hydrocarbon liquid products.

2. The process of claim 1, wherein the coal feed has a particle size of 50-350 mesh (U.S. Sieve Series) and the flowable coal/carbon dioxide slurry feedstream contains 60-90 W % coal.

3. the process of claim 1, wherein the particulate coal feed is pressurized to an intermediate pressure of 550-1000 psig and passed to a mixing tank to which the carbon dioxide liquid having a temperature of 40°-80° F. is introduced and the coal and $CO_2$ are mixed together to provide the flowable coal/$CO_2$ slurry.

4. The process of claim 1, wherein the pressurized coal/$CO_2$ slurry is fed first into a mixing chamber of said reaction zone, in which the coal is mixed with the hydrogen gas and recycled reactor liquid and the $CO_2$ liquid is substantially evaporated before being passed into the ebullated catalyst bed.

5. The process of claim 1, wherein the particulate hydrogenation catalyst contains and active metal oxide or other metal compound selected from the metals group consisting of cobalt, iron, molybdenum, nickel, tin, tungsten and mixtures thereof deposited on a base material selected from the group consisting of alumina, magnesia, silica, titania and combinations thereof.

6. The process of claim 1, wherein said recovered hydrogen is recycled and heated to a temperature at least about 50° F. above the reaction zone temperature before being fed into the reaction zone.

7. The process of claim 1, wherein reactor liquid slurry is withdrawn and heated to at least about 50° F. above the reactor temperature before being recycled to the reaction zone.

8. The process of claim 1, wherein the recovered $CO_2$ gas is cooled to 40°-85° F. and liquefied prior to being recycled to the coal slurrying step.

9. The process of claim 1, wherein the reaction zone conditions are maintained at 700°-825° F. temperature, 1500-3500 psig hydrogen partial pressure, and coal feed rate of 15-80 lb coal/hr $ft^3$ reactor volume.

10. The process of claim 1, wherein the effluent material from said catalytic reaction zone is passed to a second catalytic reaction zone maintained at 750°-850° F. temperature, and 1000-4000 psig hydrogen partial pressure for further hydroconversion reactions therein.

11. The process of claim 1, wherein the coal feed is bituminous coal and the $CO_2$ concentration in the reaction zone is 2-10 mol %.

12. The process of claim 1, wherein the coal/$CO_2$ slurry feed is cooled by evaporation a portion of the $CO_2$ from the slurry.

13. The process of claim 1, wherein the particulate coal is slurried with a mixture of $CO_2$ dissolved in water.

14. A process for hydrogenation and liquefaction of coal utilizing a coal/$CO_2$ slurry feedstream for producing hydrocarbon liquid and gas products comprising:

(a) pressurizing particulate coal having 50-375 mesh particle size (U.S. Sieve Series) to an intermediate pressure of 550-1000 psig and feeding it into a pressurized mixing tank;

(b) mixing said pressurized particulate coal with liquid carbon dioxide introduced at 40°-80° F. in the pressurized mixing tank to provide a flowable coal/carbon dioxide slurry feedstream containing 50-80 W % coal;

(c) further pressurizing the coal/$CO_2$ slurry and feeding it and hydrogen separately into a mixing chamber of a reactor, said reactor containing an ebullated catalyst bed maintained at 700°-850° F. temperature, 1000-3000 psig hydrogen partial pressure, and with a coal feed rate of 15-75 lb coal/hr $ft^3$ reactor volume, and producing an effluent material containing hydrocarbon gas and liquid fractions;

(d) separating the gas and liquid fractions, and recovering $CO_2$ and hydrogen from the gaseous fractions, recycling the $CO_2$ to the coal slurrying step and recycling the hydrogen to the reactor; and (e) separating unconverted coal and ash from the hydrocarbon liquid fraction distilling the remaining hydrocarbon liquid to produce gas and low boiling hydrocarbon liquid products.

15. A process for hydrogenation and liquefaction of coal utilizing a coal/$CO_2$ slurry feedstream for producing hydrocarbon liquid and gas products, comprising:

(a) pressurizing particulate coal having 50-375 mesh size (U.S. Sieve Series) to an intermediate pressure of 550-1000 psig and feeding it into a pressurized mixing tank;

(b) mixing said pressurized particulate coal with liquid carbon dioxide provided at 40°-80° F. in the pressurized mixing tank to provide a flowable coal/carbon dioxide slurry containing 50-90 W % coal;

(c) further pressurizing the coal/$CO_2$ slurry and feeding it and hydrogen separately into a mixing chamber of a first reactor, said reactor containing an ebullated catalyst bed maintained at 650°-850° F.

temperature, 1000–3000 psig hydrogen partial pressure, and with a coal feed rate of 10–75 lb coal/hr $ft^3$ reactor volume and producing an effluent material;

(d) passing the effluent material to a second stage reactor, said second reactor containing an ebullated catalyst bed maintained at 750°–860° F. temperature and 1000–3000 psig hydrogen partial pressure for further hydroconversion and producing an effluent material containing hydrocarbon gas and liquid fractions;

(e) separating the gas and liquid fraction and recovering $CO_2$ and hydrogen from the gaseous fractions, recycling the $CO_2$ to the coal slurrying step and recycling the hydrogen to the reactor; and (f) separating unconverted coal and ash from the hydrocarbon liquid fraction and distilling the remaining hydrocarbon liquid to produce gas and low boiling hydrocarbon liquid products.

* * * * *